United States Patent [19]

Aragona

[11] 4,058,852

[45] Nov. 22, 1977

[54] SHIRT TYPE GARMENT INCLUDING BUILT IN ARM POSITIONING MEANS

[76] Inventor: Louis Aragona, 11 Scheiber Terrace, Cedar Grove, N.J. 07009

[21] Appl. No.: 719,198

[22] Filed: Aug. 31, 1976

[51] Int. Cl.[2] ..... A41B 1/00

[52] U.S. Cl. ..... 2/115

[58] Field of Search ..... 2/115, 117, 269, 270, 2/DIG. 4; 273/188 A, 183 B, 189 R, 188 R; 128/134, 133

[56] References Cited

U.S. PATENT DOCUMENTS

| | | | |
|---|---|---|---|
| 1,600,897 | 12/1926 | Lesser | 2/269 |
| 2,717,437 | 9/1955 | De Mestral | 2/DIG. 6 |

*Primary Examiner*—Werner H. Schroeder
*Assistant Examiner*—Doris L. Troutman
*Attorney, Agent, or Firm*—Anthony F. Cuoca

[57] ABSTRACT

A shirt type garment or the like includes means associated with the upper side chest and upper side arm portions of the garment to assist the wearer in maintaining the arm in intimate contact with the side chest.

5 Claims, 3 Drawing Figures

SHIRT TYPE GARMENT INCLUDING BUILT IN ARM POSITIONING MEANS

BACKGROUND OF THE INVENTION

1. Field of the Invention

This invention relates generally to shirt type garments and particularly to shirt type garments including means for assisting the wearer of the garment to maintain the arm in a predetermined position relative to the side chest. More particularly, this invention relates to garments of the type described including means for assisting the wearer to maintain the upper arm in intimate contact with the upper side chest.

2. Description of the Prior Art

Many instances occur when it is desired to train or otherwise assist or insure that a person maintain an arm in intimate contact with the side chest. Such instances arise, for example, in training a golfer in achieving an appropriate swing, a boxer for achieving proper defensive arm positioning, or for medical purposes as may be required to promote healing as will be understood. For purposes of illustrating the invention the novel arrangement disclosed will be described with reference to a shirt type garment used as a golfer's training aid. However, the structural relationships hereinafter disclosed can be used for the above noted purposes and others as well, the same being understood by those skilled in the art.

With the above in mind, it is well known that in order for golfers to be successful in the sport, it is necessary that they develop appropriate back and forward swings. It has been found that in order for this to be accomplished, the golfer's elbow must remain pointing to the ground during both back and forward swings. In this connection, it has also been found that a particular problem suffered by golfers, especially by those just learning the sport or those who play without extensive practice, occurs when the elbow leaves this position or, in other words, when the arm is no longer in intimate contact with the side of the body during back and forward swings. This is known in the sport of golf as "flying elbow".

Various devices have been used to achieve the required arm position. Generally, these devices have been mechanical devices and have been cumbersome to use, such as that described in U.S. Pat. No. 3,680,869 issued to Joseph P. Brady on Aug. 1, 1972. A shirt type device which attempts to preclude bending of the golfer's arm, is described by U.S. Pat. No. 3,106,718 issued on Apr. 20, 1961 to J. H. Raab. These and other devices of the prior art are unnatural to use and in many ways restrict functioning of the golfer. The present invention obviates the inadequacies of the prior art devices in providing a natural, uncumbersome, simple and easy to use device to insure proper positioning of the golfer's arm while providing a warning if the arm tends to leave the proper position.

SUMMARY OF THE INVENTION

This invention contemplates a shirt type garment or the like including means for insuring the upper arm of the wearer is maintained in intimate contact with the upper side chest. "Velcro" material is secured to the upper side chest portion and the corresponding inside upper arm portion of the garment so as to provide a clinging or engaging action as long as the intimate contact is maintained. When the intimate contact is broken a resistive force is experienced and a tearing sound is generated to provide a physical and audible warning that the contact is broken, whereupon the wearer of the garment can take the necessary steps to restore the contact.

One object of this invention is to provide a shirt type garment or the like including means for insuring that the wearer maintains the arm in a pedetermined position relative to the side chest, and to provide a warning if the arm leaves the predetermined position.

Another object of this invention is to provide a garment of the type described which may be easily constructed and is natural and uncumbersome to use.

Another object of this invention is to provide a garment of the type described, which while accomplishing the aforenoted purposes, will not interfere with the activities of the wearer.

Other objects and advantages of the invention will be apparent from the following description thereof taken in conjunction with the accompanying drawings.

DESCRIPTION OF THE INVENTION

Figure 1:
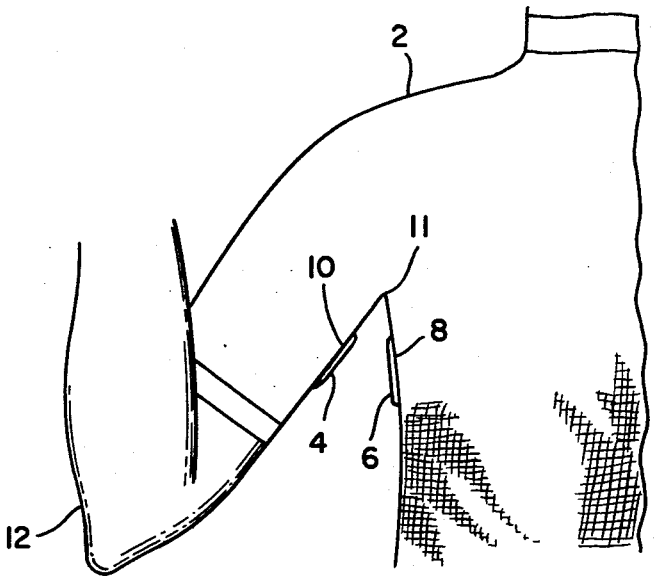
FIG. 1 is a front view showing the right hand portion of the garment of the invention, and showing the elements associated with the upper arm and upper side chest portions thereof in disengaged relation.
Figure 2:
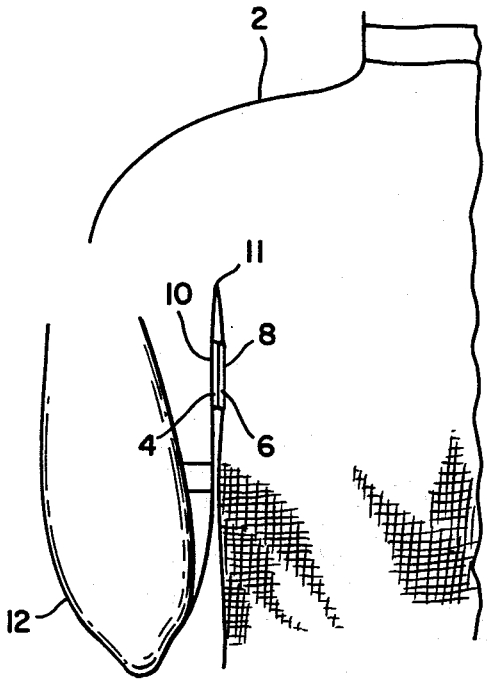
FIG. 2 is a front view showing the right hand portion of the garment of the invention, and showing the elements associated with the upper arm and upper side chest portions engaged in cooperative relation.
Figure 3:
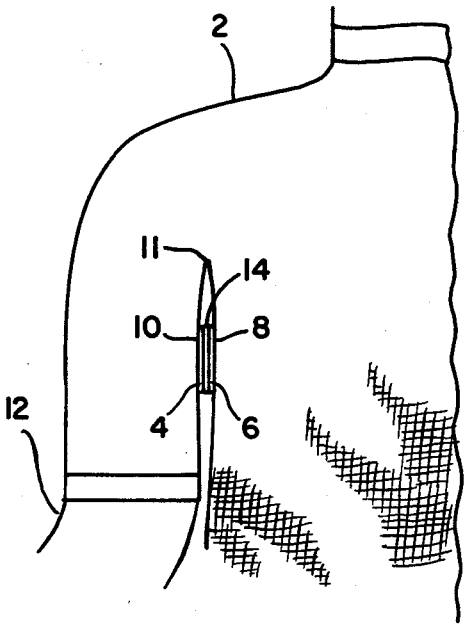
FIG. 3 is a front view showing the right hand portion of the garment of the invention, and showing an additional element wherein the cooperative relation of the elements illustrated in FIG. 2 is neutralized.

With reference to FIGS. 1, 2, and 3 there is shown a shirt designated by the numeral 2. Shirt 2 may be any type of athletic shirt, sweat shirt, sport shirt or any other shirt type garment suitable for the purposes described.

The invention employs fabric areas 4 and 6 made from a material manufactured under the trademark "Velcro" by American Velcro, Incorporated of Manchester, N.H.

"Velcro" material is actually a fabric that has the propensity, wherein when one portion thereof identified as the "pile" and the other portion thereof identified as the "loop" are pressed together, the portions mesh and cling each to the other so that a distinct force is required for separation of the pile and loop portions. Further, upon such separation an audible tearing sound occurs. The invention herein described utilizes these features.

Thus, with further reference to FIGS. 1, 2, and 3, Velcro loop portion 6 may be secured as by sewing or the like to the upper side chest potion 8 of shirt 2, while pile portion 4 may be likewise secured to the inside of the upper sleeve portion 10 of shirt 2, both of said portions 4 and 6 being close to the armpit of the shirt.

In this connection it is noted that the device of the invention is shown in an arrangement wherein the right arm and the right side chest potions of shirt 2 are arranged in accordance with the invention whereby the right arm 12 of the wearer may be disposed in intimate contact with the right side chest as will be further explained. It will be understood that a similar arrangement for the left side of the wearer's body could be provided instead. Also, shirt portion 8 may carry pile portion 4 and shirt portion 10 may carry loop portion 6 and the invention would work equally as well as will be understood.

When using the invention, such as when a golfer is practicing or training for achieving a proper forward and back swing as heretofore noted, Velcro portions 4 and 6 secured to shirt 2 are pressed together by the golfer so as to mesh or cling each to the other in cooperative relation as best shown in FIG. 2. As the golfer makes his swing, as long as his upper arm is maintained in intimate contact with his upper side chest as is desired, Velcro portions 4 and 6 will remain in the meshed or clinging condition and the purposes of the invention will be achieved. that is, the upper arm will be maintained in intimate contact with the upper side chest of the wearer's body.

If the golfer's swing is faulty, a force will be exerted which will tend to pull Velcro portions 4 and 6 away from each other. This will provide a sensation both physical and audible that will be readily discernable to the wearer of shirt 2 so as to provide a warning that the intimate contact is broken.

Thus, physically the wearer will feel a force tending to oppose the separation of Velcro portions 4 and 6, and audibly a tearing sound will be heard as the portions begin to separate. The wearer then has the opportunity to press the arm to the side of the body to reengage or remesh Velcro portions 4 and 6 in cooperative relation to maintain the arm in the desired position to accomplish the purposes intended.

With specific reference now to FIG. 3, after the golfer or other user has used the device of the invention as heretofore described for training purposes or the like, it may be desirable to perform the trained function without the benefit of the assistance that the invention provides. In this case, a neutralizing Velcro member which may be a pile portion such as portion 4 or a loop portion such as portion 6 and identified by the numeral 14, may be inserted between portions 4 and 6 so as to cling or mesh with the opposite portion, but yet neutralize any cooperative action between Velcro portions 4 and 6 thereby giving the user the opportunity to practice the trained function independent of the invention as may be desired.

The invention has been described with reference to a golfer's training aid. It will be realized that in properly executing a back swing a right handed golfer puts his right arm in a relatively weak position, which is as it should be. This allows the left side of the golfer's body to act as a prime force in the overall golf swing and subdues the right side of the body until the swing is completed, and at which time the right side of the body predominates, i.e. the followthrough. Of course, the opposite is true for a left handed golfer. The Velcro material in the arrangement as described with relation to FIGS. 1 and 2 will maintain the golfer's arm in intimate contact with his side chest until the final turnover or crossover of the swing takes place and at which stage Velcro portions 4 and 6 will separate but will not affect the overall results of the golfer's swing. In other words, the invention will not interfere with the further activities of the golfer.

It will be understood that Velcro elements 4 and 6 can easily be sewn or otherwise secured to the respective portions of shirt 2 by the user himself. Shirt 2 may best be a shirt having no unusual characteristics and may be such as ordinarily worn by the user.

The Velcro material will not be affected by cleaning or washing of the shirt as is desirable for the purposes intended. As particularly pointed out, when the need for the assistance provided by the invention is no longer required element 14 may be used. The assistance thus provided is unobtrusive and provides the user of the invention with flexibility in first practicing aided by the invention and then actually executing the desired function independent of the invention.

The device of the invention, as heretofore described, provides the assistance necessary in maintaining the upper arm in the desired position relative to the upper side chest, and provides a physical and audible warning when this position deteriorates. The invention can thus be used for a variety of purposes involving these portions of the body as will not be understood by those skilled in the art.

It will be further understood that various changes may be made in the arrangement, design and construction of the parts of the invention without departing from the spirit and scope thereof as described in the following claims. For example, Velcro portions 4 and 6 may be any size or shape desired depending on the intended use of the invention, size of the user and other variables as well.

What is claimed is:

1. A shirt type garment for assisting a wearer to maintain an arm in intimate contact with a side chest, comprising:

first means secured to an upper side chest portion of the garment near the armpit of the wearer;

second means secured to the corresponding upper side arm portion of the garment near the armpit of the wearer;

said first and second means being in clinging engagement when the upper arm of the wearer is pressed into intimate contact with the upper side chest;

a physical and audible warning being provided when the intimate contact is broken: and third means disposed intermediate the first and second means to neutralize the clinging engagement of the first and second means when the upper arm of the wearer is pressed into intimate contact with the upper side chest.

2. A shirt type garment as described by claim 1, wherein:

the first means includes one of the loop and pile elements of a loop-pile fastener;

the second means includes the other of the loop and pile elements of the loop-pile fastener; and the third means disposed intermediate the first and second means to neutralize the clinging engagement of the first and second means when the upper arm of the wearer is pressed into intimate contact with the upper side chest corresponds to one of the loop and pile elements.

3. A shirt type garment as described by claim 1, wherein:

the physical warning provided when the intimate contact is broken is a force discernable to the wearer and tending to oppose the breaking of the intimate contact.

4. A shirt type garment as described by claim 1, wherein:

the audible warning provided when the intimate contact is broken is a tearing sound discernable to the wearer and indicative of the breaking of the intimate contact.

5. A shirt type garment for assisting a wearer to maintain an arm in intimate contact with a side chest, comprising, a loop element of a loop-pile fastener secured to the side chest potion of the garment;

a pile element of the loop-pile fastener secured to the corresponding inside arm portion of the garment, the loop and pile elements being in clinging engagement when the arm of the wearer is pressed into intimate contact with the side chest;

a force tending to oppose the separation of the loop and pile elements and being discernable to the wearer when the intimate contact is broken;

a tearing sound discernable to the wearer upon separation of the loop and pile elements and indicative that the intimate contact is being broken: and an element corresponding to one of the loop and pile elements disposed intermediate the loop and pile elements and being in clinging engagement with one of the loop and pile elements, and neutralizing the clinging engagement of said elements.

* * * * *